United States Patent [19]

Nomura et al.

[11] Patent Number: 4,938,471

[45] Date of Patent: Jul. 3, 1990

[54] THREAD WOUND GOLF BALL

[75] Inventors: Jun Nomura, Yokohama; Masaaki Kaida, Higashiyamato, both of Japan

[73] Assignee: Bridgestone Corporation, Tokyo, Japan

[21] Appl. No.: 376,315

[22] Filed: Jul. 5, 1989

[30] Foreign Application Priority Data

Jul. 5, 1988 [JP] Japan ..... 63-167119

[51] Int. Cl.[5] ..... A63B 37/06

[52] U.S. Cl. ..... 273/227; 273/234; 273/235 R

[58] Field of Search ..... 273/227, 226, 225, 224, 273/222, 216, 62, 234, 235 R

[56] References Cited

U.S. PATENT DOCUMENTS

| | | | |
|---|---|---|---|
| 622,834 | 4/1899 | Work et al. | 273/227 |
| 712,611 | 11/1902 | Spear | 273/227 |
| 3,134,598 | 5/1964 | Muccino | 273/227 |
| 4,783,078 | 11/1988 | Brown et al. | 273/227 |

*Primary Examiner*—George J. Marlo

*Attorney, Agent, or Firm*—Birch, Stewart, Kolasch & Birch

[57] ABSTRACT

A golf ball comprising a core having a thread rubber continuously wound thereon and a cover becomes more durable when at least 8 turns of every ten turns of thread rubber around the core have a crossing angle between two consecutive turns in the range of 12° to 45°.

4 Claims, 3 Drawing Sheets

THREAD WOUND GOLF BALL

This invention relates to thread wound golf balls, more particularly, to golf balls in which thread rubber is wound on a core to form a core ball which is enclosed in a cover.

BACKGROUND OF THE INVENTION

In the prior art, thread wound golf balls are generally manufactured by winding a rubber thread with a high elongation on a core of rubber or liquid to form a core ball, and enclosing the core ball in a cover. For winding thread rubber around the core, there are known twc techniques, a random winding or basket winding technique and a great circle winding technique.

The random winding technique is disclosed in Japanese Patent Application Kokai Nos. 15363/1985 and 15364/1985 and may be carried out with an apparatus as shown in FIG. 1. The winding apparatus 10 of FIG. 1 includes a pair of drive rollers 12 and 14 on which a core 16 rests. The winding apparatus 10 further includes a pneumatic cylinder 24 coupled to a support 26 which bears for rotation idle rollers 20 and 22 in press contact with the core 16. The drive rollers 12 and 14 cooperate to rotate the core 16 while the drive rollers alternatively move back and forth in an axial direction. While the core 16 randomly rotates in this way, a rubber thread 18 is wound on the core 16 through the idle rollers 20 and 22. The pneumatic cylinder 24 is periodically actuated to reduce the pressing force of the idle rollers 20 and 22 against the core 16, making motion of the core 16 free from the drive rollers 12 and 14. This allows the core 16 to spontaneously move such that the rubber thread 18 is wound with where it has been wound less turns. In this way, the rubber thread 18 is eventually wound in a spherical form as a whole. Although the rubber thread orbits have a basic pattern of sine wave.like curves drawn on a sphere, periodic release of the core 16 from the drive rollers 12 and 14 induces a periodic change in the orbital curves, eventually providing random orbits.

The great circle winding technique is disclosed in Japanese Patent Application Kokai No. 211275/1986 and may be carried out with an apparatus as shown in FIGS. 2A and 2B. The winding apparatus 30 of FIGS. 2A and 2B includes a center-tapered drive roller 32, a center-bulged idle roller 34, and a holding idle roller 36 arranged at apexes of a triangle for supporting a core 40. Rotation of the drive roller 32 causes the core 40 to rotate whereby a rubber thread 42 is wound on the core 40 through the drive roller 42. Since only the drive roller 32 imparts rotation to the core 40, the rubber thread 42 is wound on the core 40 along its great circle. Because of the configuration and arrangement of the rollers, every turn of rubber thread 42 has its orbit moved slightly off the previous orbit. As a consequence, the rubber thread 42 is wound along orbits spreading like a fan shape as shown in FIG. 3. The great circle winding technique has an advantage that the winding apparatus is simple.

The thread wound golf balls are manufactured by winding thread rubber on a core by either of the above.-mentioned techniques to form a core ball and then enclosing the core ball with a cover as by press molding. Conventional thread wound golf balls have a drawback that the covers are ruptured and the balls are deformed by hitting because they are less durable against impact.

The bond between the cover and the thread rubber layer is one of the factors which contributes to the hitting durability of thread wound golf balls. In addition to the fact that the durability of the cover material and thread rubber themselves is important, the cover tends to be readily ruptured if it is not in tight bond to the underlying thread rubber layer. To enhance the bond between the cover and the thread rubber layer, it is critical how the covering material well penetrates through the thread rubber layer during heat press molding of the cover. The penetration of the covering material is generally promoted by increasing the heating temperature and/or time during heat press molding. An increased heating temperature and an extended heating/pressing time assist in the penetration of the covering material, but cause the thread rubber to deteriorate and the ball to lose its hardness and performance.

SUMMARY OF THE INVENTION

An object of the present invention is to provide a novel and improved golf ball having improved durability in which covering material is well penetrated through a thread rubber layer without increasing the heating temperature and/or time during heat press molding of the cover.

The inventors have found that the crossing angle between two consecutive thread rubber turns is one of the parameters capable of enhancing penetration of covering material into the thread rubber layer without increasing the heating temperature and/or time during heat press molding of the cover. As the crossing angle between thread rubber turns is reduced, there is available a smaller interstice between thread rubber turns, that is, the rubber thread is more tightly wound. Conversely, as the crossing angle between thread rubber turns is increased, there is available a larger interstice between thread rubber turns, that is, the rubber thread is thinly wound. Table 1 shows the weight and outer diameter of the thread wound cores or core balls corresponding to various crossing angles between thread rubber turns. The weight and outer diameter reported are an average of ten samples.

TABLE 1

| Crossing angle (°) | 10 | 20 | 30 | 40 | 50 |
|---|---|---|---|---|---|
| Wound core weight (g) | 34.80 | 34.70 | 34.60 | 34.55 | 34.50 |
| Wound core diameter (mm) | 39.2 | 39.3 | 39.0 | 39.4 | 39.1 |

As seen from Table 1, the weight of the core ball is in proportion to the winding density of thread rubber. The smaller the winding density and the larger the interstice, the more the covering material penetrates into the thread rubber layer, leading to improved ball durability.

The rubber thread orbits have a basic pattern of sine wave-like curves drawn on a sphere in the case of random winding as previously described. As the crossing angle between turns is increased, the amplitude of the sine wave-like curve is increased. Thus the peak and valley of the curve are largely spaced apart from the center line (that is, a circunferential line defined by a great circle of the core). This means that the rubber thread is wound around the core off its center, leading to the undesirable fact that the rubber thread tends to unravel and loosen from the preformed core ball. Even when the rubber thread does not loosen from the preformed core ball, the rubber thread turns will become loose within the thread layer during molding of the cover or upon actual hitting, causing the ball to deform.

Therefore, too large or too small crossing angles between thread rubber turns are inadequate for the purpose. The inventors have found that optimum results are obtained when the crossing angle is in the range of from 12° to 45°. More particularly, when at least 8 turns among every ten turns of thread rubber around the core have a crossing angle of 12° to 45°, the covering material can fully penetrate into the thread rubber layer and the rubber thread is prevented from loosening, resulting in a durable golf ball.

According to the present invention, there is provided a golf ball comprising a core ball having a core and a thread rubber continuously wound thereon and a cover enclosing the core ball, wherein for every ten turns of thread rubber around the core, at least 8 turns have a crossing angle in the range of 12° to 45°, the crossing angle being defined between the orbit of one full turn of thread rubber wound around the core and the orbit of a subsequent full turn of thread rubber wound around the core.

In the prior art thread wound golf balls, the crossing angle between thread rubber turns is in the range of 50° to 60° for random winding and about 8° for great circle winding. Conventional golf balls with thread rubber wound at such a too large or too small crossing angle are unsatisfactory in durability. Unexpectedly, by setting the crossing angle substantially to the range of 12° to 45°, the golf ball of the invention becomes fully durable in that the covering material fully penetrates into the thread rubber layer and the rubber thread is prevented from loosening.

BRIEF DESCRIPTION OF THE DRAWINGS

The above and other objects, features, and advantages of the present invention will be better understood from the following description taken in conjunction with the accompanying drawings, in which.

DETAILED DESCRIPTION OF THE INVENTION

The golf ball according to the present invention includes a spherical core. A thread of natural rubber, isoprene rubber or the like is continuously wound on the core with turns. The core may be either a liquid center or a solid center. The liquid center is a spherical NR based rubber filled with liquid and the solid center is a spherical solid BR and/or NR base rubber. The core generally has a weight of about 15 to 25 grams and a diameter of about 26 to 30 mm. Whenever the rubber thread is wound around the core ten turns, at least 8 turns have a crossing angle in the range of 12° to 45°, with the crossing angle being defined as the angle between the orbit of one full turn of thread rubber wound around the core and the orbit of a next full turn of thread rubber wound around the core. Preferably at least 9 turns have a crossing angle in the specific range for every ten turns. The preferred range of crossing angle is from 15° to 25°. It is preferred for spherical winding that the remaining one or two turns, if any, have a crossing angle of less than 12°.

Figure 4:
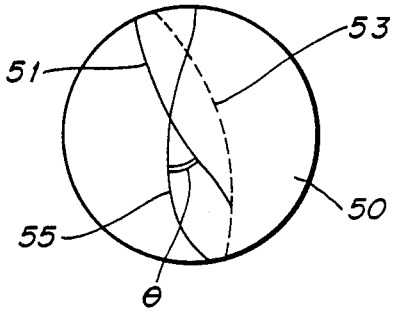
FIG. 4 illustrates the crossing angle between rubber thread turns.

FIG. 4 illustrates the crossing angle between rubber thread turns. The rubber thread is wound on core 50 with two turns in the figure. A first turn orbit consists of a front segment 51 on the front side of the core 50 depicted by a solid line and a rear segment 53 on the rear side of the core depicted by a broken line. Similarly, a second turn orbit consists of a front segment 55 depicted by a solid line and a rear segment (not shown). The crossing angle 0 is the angle between the first and second turn orbits, that is, between the segments 51 and 53 in FIG. 4.

According to the present invention, a rubber thread is wound with a plurality of turns, 1,000 to 3,000 turns, at a relatively large crossing angle for the purpose of promoting penetration of covering material into the rubber thread layer to improve the durability of the associated ball. From the standpoint of promoted penetration of covering material, all the turns of rubber thread from the inside surface of the rubber thread layer adjacent the core to the outside surface of the layer need not have a crossing angle of 12° to 45°. Instead, those turns in a region of the rubber thread layer that radially extends at least about 3.0 mm from the outside surface should meet the requirement that at least 8 turns have a crossing angle of 12° to 45° for every ten turns.

Most often, the original thread rubber before winding has a width of about 1.0 to 2.8 mm and a thickness of about 0.3 to 1.0 mm. It is wound under a tension of about 200 to 600 grams/thread.

Figure 1:
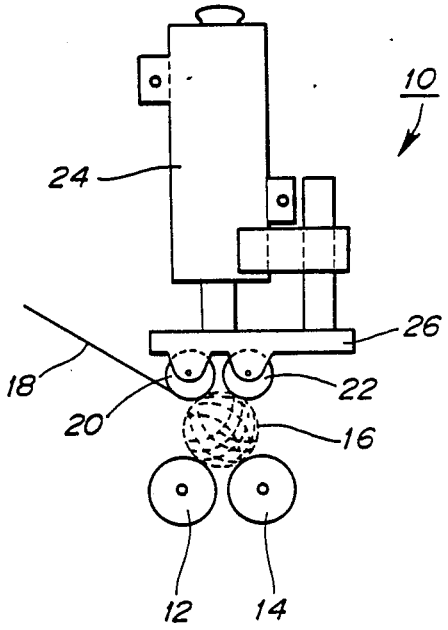
FIG. 1 is a schematic elevation of a random winding apparatus.
Figure 3:
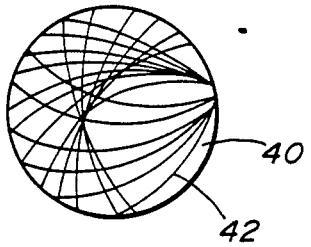
FIG. 3 illustrates the pattern of a rubber thread wound on a core by means of the apparatus of FIGS. 2A and 2B.
Figure 2A:
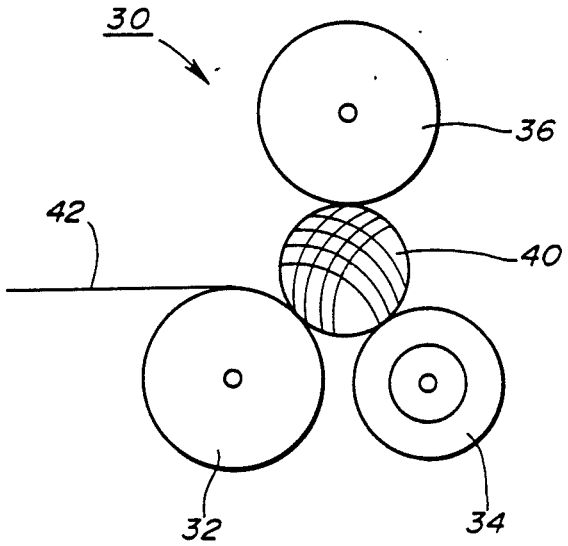
FIGS. 2A and 2B are front and side schematic elevations of a great circle winding apparatus.
Figure 2B:
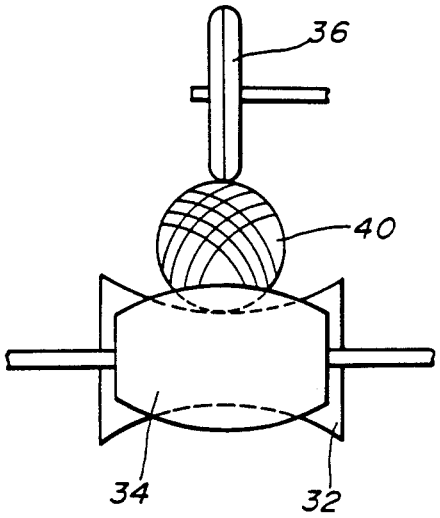

The method for preparing the golf ball according to the present invention is not particularly limited. Both the random and great circle winding techniques previously mentioned may be employed. In the case of random winding with the apparatus shown in FIG. 1, the crossing angle may be controlled by changing the stroke or period of axial motion of drive rollers 12, 14. In an example, a rubber thread was wound on a core having a diameter of 38.0 mm while changing the stroke of axial motion of drive rollers 12, 14. Table 2 shows the stroke of axial motion of drive rollers and the resulting crossing angle consecutive turns of rubber thread in the example. The period of axial motion of the drive rollers was changed to allow for 0.5 to 2.0 strokes of axial motion per revolution of the core so as to provide the desired crossing angle.

TABLE 2

| | | | | | | |
|---|---|---|---|---|---|---|
| Stroke (mm) | 3.8 | 4.2 | 4.8 | 5.4 | 6.0 | 6.4 |
| Crossing angle (°) | 20 | 20 | 30 | 40 | 50 | 60 |

In the case of random winding, if only the stroke or period of axial motion of the drive rollers 12 and 14 is used as the means for controlling spherical cross winding, then the thread is wound in a cylindrical manner. The thread can be wound in a spherical manner without such inconvenience by periodically actuating the pneumatic cylinder 24 to reduce the pressing force of the idle rollers 20 and 22 against the core 16, allowing the core 16 to move relatively free from the drive rollers 12 and 14, thus allowing the axis of rotation of the core 16 to be randomly varied with respect to the axis of translating motion of the drive rollers 12 and 14. Alternatively, the thread can be wound in a spherical manner by periodically delaying the cycles of rotation and axial motion of the drive rollers 12 and 14. There is a possibility that some turns are wound at crossing angle of less than 12°.

If the proportion of the turns having a crossing angle of less than 12° is too large, the thread is rather wound in a cylindrical manner, causing the ball to lose true sphericity. Further, if the proportion of the turns having a crossing angle of less than 12° is too large, penetration of covering material into the thread layer is rather prevented, failing to provide durability. For this reason, at least 8 turns, preferably at least 9 turns, have a crossing angle of 12° to 45° for every ten turns.

The cross sectional shape of the rubber thread at the end of winding also affects the penetration of covering material into the rubber thread layer. A smaller cross-sectional area leads to a dense winding to prevent penetration of covering material whereas a larger cross sectional area leads to a sparse winding to promote penetration of covering material. Since a rubber thread having a too large cross-sectional area shows a larger tension for the same elongation, the rubber thread tends to loosen when the stroke of axial motion of the drive rollers 12 and 14 is increased. From this consideration, the cross sectional shape of the wound rubber thread should preferably have an optimum set of dimensions depending on a particular crossing angle. For crossing angles in the range of from 12° to 45° according to the present invention, the wound rubber thread is preferably of a generally rectangular cross section having a breadth of 0.3 to 1 mm, more preferably 0.45 to 0.65 mm and a thickness of 0.10 to 0.20 mm, more preferably 0.15 to 0.18 mm.

The core ball is finally enclosed in a cover typically of balata and ionomer resins with a thickness of about 0.5 to 3 mm. The completed golf balls should meet the standards, typically have a weight of 45.3 grams or less and a diameter of 42.67 mm or more in the case of large balls and a weight of 45.3 grams or less and a diameter of 41.15 mm or more in the case of small balls. There has been described a thread rubber wound golf ball in which a rubber thread is continuously wound around a core whereby the crossing angle between the orbit of one full turn of rubber thread and the orbit of a subsequent full turn of rubber thread is substantially in the range of 12° to 45°. Then the rubber thread is wound over the core at a sufficient density to allow the subsequently applied covering material to penetrate between the turns and at a sufficiently tight manner to prevent the rubber thread from loosening. The resulting golf ball is satisfactorily durable.

EXAMPLE

Examples of the present invention are given below together with comparative examples by way of illustration and not by way of limitation. All parts and percents are by weight unless otherwise stated.

EXAMPLES 1-17 and COMPARITIVE EXAMPLES 1-9

The core used was a liquid center having a diameter of 27.6 mm. The rubber material used was a rubber thread of rectangular cross section having a breadth of 1.6 mm and a thickness of 0.5 mm. The rubber used for the core and thread was a 50/50 mixture of NR and IR. Core balls were prepared by randomly winding the rubber thread on the core and then covered with a covering material. There were obtained thread wound golf balls of Examples 1-13 Comparative Examples 1-9, which were evaluated for durability. The results are shown in Tables 3 to 6.

For the balls shown in Tables 3 and 4, the covering material was a composition containing 100 parts of synthetic balata (isoprene rubber manufactured by Kurare K.K.), 3 parts of titanium white, 1 part of sulfur, and 5 parts of zinc white. The core ball having the thread wound thereon had a diameter of 40.3 mm and the finally covered ball had a diameter of 42.7 mm. For the balls shown in Table 3, the rubber thread at the end of winding had a breadth of 0.51 mm and a thickness of 0.16 mm as measured by an optical cross section meter.

For the balls shown in Table 5, the covering material was an ionomer resin (Surlyn #1557 manufactured and sold by E. I. duPont). The core ball had a diameter of 39.0 mm and the final ball had a diameter of 42.7 mm. The rubber thread at the end of winding had a breadth of 0.51 mm and a thick ness of 0.16 mm as measured by an optical cross section meter.

Molding of the covering material was carried out by conventional press molding involving preparing half shells of the covering material and enclosing the core ball in the half shells, followed by heating. The heating temperature and time are reported in the row of "heating conditions" in Tables 3 to 5. The temperature and time reported are a temperature to which the mold was heated from room temperature and a time taken from the start of heating to the end of heating (including a temperature rising period). At the end of heat molding, the article was immediately cooled down.

In Tables 3 to 5, the depth of penetration of covering material is the distance over which the covering material penetrated into the rubber thread layer from its outer surface. The compression is a deflection (mm) under a constant load of 100 kg. The durability was tested by repeatedly hitting the ball with a testing golf head at a head speed of 40 m/sec. until the ball was broken or deformed. The number of hits were repeated until one-half of ten samples were deformed or broken, which was recorded. The results were evaluated in three grades of ○, Δ, and X, with the following criterion.

○ : 300 to 400 hits
Δ: 200 to less than 300 hits
X: less than 200 hits

TABLE 3

| | Balata cover | | | | | |
|---|---|---|---|---|---|---|
| | CE1 | CE2 | E1 | E2 | E3 | CE3 |
| Heating conditions | 100° C. × 10 min. | " | " | " | " | " |
| Crossing angle, ° | 8 | 10 | 15 | 30 | 45 | 50 |
| Penetrating depth of covering material, mm | 2.3 | 2.8 | 3.2 | 3.4 | 3.3 | 3.4 |
| Ball compression, mm | 2.1 | 2.1 | 2.5 | 2.3 | 3.0 | 2.8 |
| Durability | Δ | Δ | O | O | O | X |

TABLE 4

| | Balata cover | | | | |
|---|---|---|---|---|---|
| | E4 | E5 | E6 | E7 | E8 |
| Heating conditions | 140° C. × 7 min. | " | " | " | " |
| Crossing angle, ° | 12 | 12 | 12 | 12 | 12 |
| Penetrating depth of covering material, mm | 1.7 | 1.5 | 2.0 | 1.3 | 1.6 |
| Ball compression, mm | 3.2 | 3.0 | 4.5 | 3.0 | 4.1 |
| Rubber strip. | | | | | |
| Thickness*, mm | 0.15 | 0.11 | 0.16 | 0.15 | 0.15 |
| Breadth*, mm | 0.60 | 0.60 | 0.60 | 0.47 | 0.90 |

TABLE 4-continued

| | Balata cover | | | | |
|---|---|---|---|---|---|
| | E4 | E5 | E6 | E7 | E8 |
| Durability | O | O | O | O | O |

*after winding

TABLE 5

| | Ionomer cover | | | | | | |
|---|---|---|---|---|---|---|---|
| | CE4 | CE5 | E9 | E10 | E11 | CE6 | CE7 |
| Heating conditions | 160° C. 7′ | 160° C. 9′ | 140° C. 7′ | 130° C. 7′ | 130° C. 6′ | 130° C. 6′ | 130° C. 6′ |
| Crossing angle, ° | 8 | 8 | 12 | 30 | 45 | 50 | 60 |
| Penetrating depth of covering material, mm | 1.4 | 2.2 | 1.7 | 2.0 | 1.9 | 2.2 | 2.3 |
| Ball compression, mm | 4.2 | 4.7 | 3.3 | 2.9 | 2.1 | 2.1 | 2.5 |
| Durability | Δ | Δ | O | O | O | Δ | X |

TABLE 6

| | Ionomer cover | | | |
|---|---|---|---|---|
| | E12 | E13 | CE8 | CE9 |
| Crossing angle, ° | 15 | 15 | 15 | 15 |
| Turns having a crossing angle of 12–45° per 10 turns | 9 | 8 | 7 | 6 |
| Durability | O | O | Δ | X |

We claim:

1. In a golf ball comprising a core ball having a core and a thread rubber continuously wound thereon and a cover enclosing the core ball, the improvement wherein for every ten turns of thread rubber around the core, at least 8 turns have a crossing angle in the range of 12° to 45°, the crossing angle being defined between the orbit of one full turn of thread rubber wound around the core and the orbit of a subsequent full turn of thread rubber wound around the core.

2. The golf ball of claim 1 wherein in a region of the rubber thread layer that radially extends at least about 3.0mm from the outside surface, at least 8 turns of every ten turns have a crossing angle of 12° to 45°.

3. The golf ball of claim 1 wherein the rubber thread is of a generally rectangular cross section having a breadth of 0.3 to 1 mm and a thickness of 0.10 to 0.20 mm in the wound state.

4. The golf ball of any one of claim 1 to 3 wherein the remaining turns of every ten turns have a crossing angle of less than 12°.

* * * * *